US005310435A

United States Patent [19]

Kelly

[11] Patent Number: 5,310,435

[45] Date of Patent: May 10, 1994

[54] METHOD FOR MAKING CORNERS FOR LAMINATE AND VENEER COUNTERTOPS

[76] Inventor: Basil T. Kelly, 6625 SW. Robbins Rd., Tualatin, Oreg. 97062

[21] Appl. No.: 67,338

[22] Filed: May 24, 1993

Related U.S. Application Data

[60] Continuation of Ser. No. 811,293, Dec. 20, 1991, which is a division of Ser. No. 435,544, Nov. 13, 1989, abandoned.

[51] Int. Cl.[5] ..... A47B 13/08; B32B 31/04; B32B 31/18

[52] U.S. Cl. ..... 156/182; 52/783; 52/813; 156/212; 156/257; 156/267; 156/293

[58] Field of Search ..... 156/258, 182, 267, 293, 156/212, 256, 257; 52/813, 822, 783, 829, 830, 814, 784, 821; 108/27

[56] References Cited

U.S. PATENT DOCUMENTS

| | | | |
|---|---|---|---|
| 1,381,916 | 6/1921 | Gunn | 156/256 |
| 1,705,156 | 3/1929 | Larson | 52/783 |
| 2,717,187 | 9/1955 | Morgan et al. | 52/783 |
| 2,813,766 | 11/1957 | Shumaker et al. | 52/784 |
| 3,382,124 | 5/1968 | Briskey | 156/212 |
| 4,996,817 | 3/1991 | Nelson | 52/783 |
| 5,085,027 | 2/1992 | McClung et al. | 52/783 X |

*Primary Examiner*—Michael W. Ball
*Assistant Examiner*—Michele K. Yoder
*Attorney, Agent, or Firm*—Chernoff, Vilhauer, McClung & Stenzel

[57] ABSTRACT

A countertop having a laminate or veneer horizontal upper surface and a laminate or veneer vertical face, has a corner element with an arcuate surface that smoothly fairs into both the upper surface and the face The countertop is made by leaving the vertical edge of the deck unfinished and placing the vertical veneer strip on an edge piece which then is attached to the edge of the deck. The edge piece is made from a block having the vertical veneer strip attached to one of its sides. Notches are formed at the top and bottom of this side of the block and rectangularly cross section strips, from which the corner elements will be formed, are glued in the notches. These strips are then machined to form the smooth arcuate surfaces that will fair into the laminate strip. The back of the block and the top edge of the upper strip are then machined to create the end piece which mates with the countertop deck.

2 Claims, 1 Drawing Sheet

FIG. 1
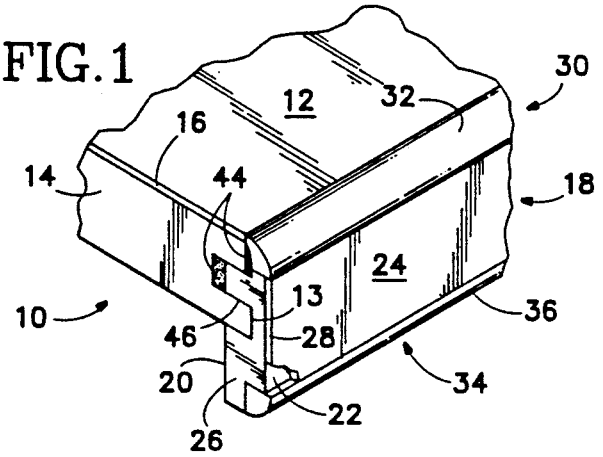
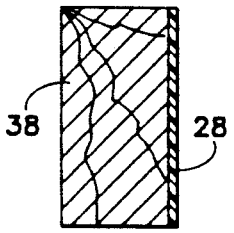
FIG. 2
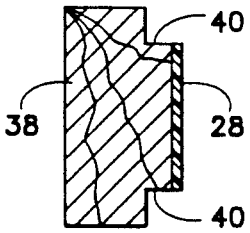
FIG. 3
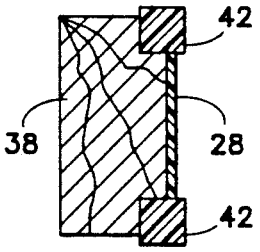
FIG. 4
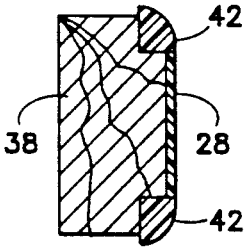
FIG. 5
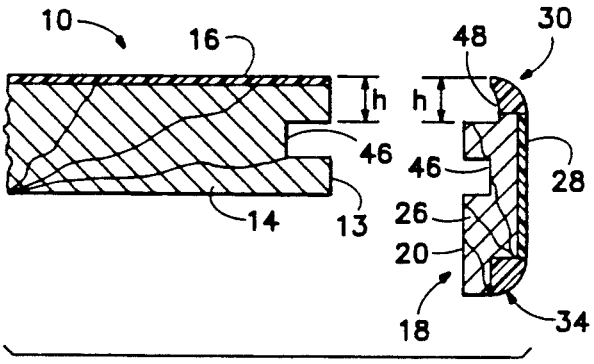
FIG. 6
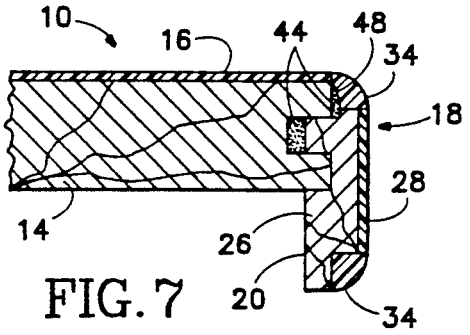
FIG. 7
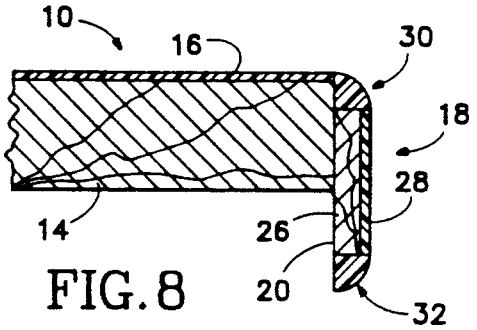
FIG. 8
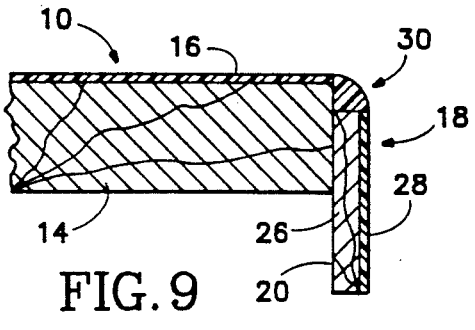
FIG. 9

METHOD FOR MAKING CORNERS FOR LAMINATE AND VENEER COUNTERTOPS

This is a continuation of copending application Ser. No. 07/811,293 filed on Dec. 20, 1991 which is a division of application Ser. No. 07/435,544 filed Nov. 13, 1989 now abandoned.

BACKGROUND AND SUMMARY OF THE INVENTION

This invention relates to countertops, and in particular to a smooth edge for laminate or veneer countertops.

When laminates or veneers are used on both the horizontal upper surface and the vertical face of countertops, such as kitchen cabinets, tables, furniture and the like, there necessarily is a sharp right angle corner between the horizontal and vertical surfaces. Because of its sharpness, this corner is easily damaged when it is hit and when damaged it is difficult to repair. This susceptibility to damage is made worse by the fact that most laminates are made from a relatively soft, easily damaged material. In addition, a sharp, right angle corner is not as aesthetically pleasing as a rounded corner in most countertop applications. Finally, when laminates or veneer surfaces are joined at right angles with respect to one another, a black line is created at their intersection by the edge of one of the laminate or veneer pieces. In the case of laminates, which are necessarily relatively thick, this black line is quite pronounced. While laminates are the preferred material for many applications, due to their durability and ease of maintenance, and veneers are the preferred material for many applications, due to their low cost, the inability to put a smooth rounded corner between the horizontal surface and vertical face of countertops made from these materials has made them less desirable than they otherwise would be.

The subject invention overcomes the foregoing shortcomings and limitations of laminate and veneer countertops by leaving the vertical edge of the deck unfinished and placing the vertical strip of laminate material on a separate edge piece which is attached to the edge of the deck. A first corner element located between the horizontal and vertical laminate pieces has an arcuate finished surface which fairs into both pieces of laminate. Thus, the edges of both pieces of laminate are covered by the corner element and no black line is formed. In addition, a rounded more aesthetically pleasing, less easily damaged corner is created. Finally, by making the corner element from a thermoplastic solid surface material, such as CORIAN, a tougher material is located in the corner making it even less easily damaged. If desired, a second corner element, similar to the first corner element, can be placed at the lower corner of the edge piece to give a more rounded appearance. The second corner element also has an arcuate surface that fairs into the vertical laminate strip.

The edge piece of the subject invention is made by cutting notches in the corners of a rectangular cross sectioned block having laminate attached to its face. Rectangular strips from which the corner elements will be formed are then glued into the notches. The sides of the strips are slightly larger than the notches so that they project slightly from the top and front of the block. The strips are then machined to form smooth arcuate surfaces which fair into the surface of the laminate strip. Finally, the back of the block and the remaining overhang portions of the corner elements are cut to form the finished edge piece that mates with the deck.

In a preferred embodiment of the invention, a tongue and groove joint is cut in the back of the edge piece and the edge of the deck to facilitate attachment of the edge piece to the deck with the upper corner element aligned with the top laminate surface. Thus, edge pieces can be produced as separate items that can be installed on cabinets having a deck with matching or complementary top surfaces and an unfinished edge. All that is required to obtain a perfect fit is to cut the tongue and groove joint in the edge of the deck the same distance below the laminate surface as it is below the top edge of the first corner element on the edge piece.

Accordingly, it is a principal object of the present invention to make a countertop having a laminate or veneer horizontal top surface and vertical edge face in which the edges of the laminate or veneer are not exposed.

It is a further object of the subject invention to make a countertop having a laminate or veneer horizontal top surface and vertical edge face with a rounded corner between the top surface and edge face.

It is a still further object of the subject invention to provide such a countertop which has a rounded corner at the bottom of the edge face.

It is a further object of the present invention to provide such a countertop in which the corner is harder than the top surface and the edge face.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a fragmentary perspective view of a countertop embodying the subject invention.

FIGS. 2–7 are cross-sectional views showing the sequence of construction of the edge piece of the countertop.

FIG. 8 is a cross-sectional view of another embodiment of the invention.

FIG. 9 is a cross-sectional view of yet another embodiment of the invention.

PREFERRED EMBODIMENT OF THE INVENTION

Referring to FIG. 1 of the drawings, the countertop of the subject invention comprises a deck 10 having a horizontal finished upper surface 12 and an unfinished vertical edge 13. In the drawings the deck is shown as an unfinished substrate 14 and the finished upper surface is a sheet of laminate 16 which is adhesively attached to the substrate. Countertops of this type are commonly used on kitchen cabinets and similar structures. However, the invention can also be utilized with decks made from veneer covered wood or similar materials, such as is used on tables, desks, and other furniture items. The unfinished vertical edge 13 is covered by an edge piece 18 having a first planar side 20 which abuts the unfinished deck edge 13, and a second planar side 22 which is parallel with and opposed to the first side 20. The second side 22 of the edge piece 18 has a finished face 24, which is the same as or complementary to the finished upper surface on the deck. In the embodiment illustrated, the edge piece is an unfinished substrate, and the finished face 24 is a strip of laminate 28 which is adhesively attached to its second side 22. However, the edge piece also can be veneer covered wood or other similar material.

The upper intersection of the deck and the edge piece contains a first corner element 30. The first corner element is attached to the upper edge of the edge piece and has a curved finished surface 32 which fairs into both the finished surface 12 of the deck and the finished face 24 of the edge piece. Thus, the first corner element eliminates the line which normally occurs between adjoining perpendicularly exposed laminate or veneer surfaces. A second corner element 34 is located at the lower edge of the edge piece to provide symmetry. The second corner element 34 has a curved surface 36 which fairs into the finished face 24 of the edge piece.

Referring to FIGS. 2–7, in a preferred embodiment the edge piece 18 is made from an elongate rectangularly cross-sectioned block 38 of substrate material which has approximately the same height as the desired edge piece but is somewhat thicker, FIG. 2. The laminate strip 28 is attached to one side of the block 38 and rectangular notches 40 are cut in the upper and lower edges of the laminate side of the block, FIG. 3. The substrate preferably is formed from wood or a wood substitute.

Rectangular strips 42, of a surface material which can be cut with a shaper, are placed in the notches 40 and secured to the block 38 by means such as glue. The preferred material for the strips 42 when they are used with a laminate surfaced deck, is a solid surface thermoplastic material of the type sold under the trademark CORIAN. The strips 42 are slightly larger in cross section than the notches 40 and thus protrude slightly above the front and the ends of the block 38, FIG. 4. Next, an arcuate surface is cut on the strips 42 by a shaper in a manner such that they fair into the laminate strip 28 on the front of the block 38 but still project slightly from its ends, FIG. 5.

Finally, the back side of the block and the overhanging portions of the strips are cut with a router to form a finished end piece 18 that mates with the deck, thus forming the first corner element 30. In a preferred embodiment, shown in FIGS. 1 and 7, one side of a tongue and groove joint 46 is formed in the back side of the block 38, with the height between the edge of the first corner element 30 and the tongue and groove joint 46 being a predetermined distance "h". The matching side of the tongue and groove joint can then be cut in the edge 13 of the deck substrate 14 with the distance between the top of the laminate sheet 16 and the tongue and groove joint being equal to the distance "h". This permits the edge pieces to be made in advance and then installed on a deck on-site, and still have a smoothly faired surface between the deck laminate 16 and the first corner element 30. With this embodiment the back of the block is cut to provide a glue slot 48 so that excess amounts of the glue 44 used to attach the edge piece to the deck will not be squeezed out onto the finished surfaces. If desired, the tongue and groove joint can be eliminated and the edge piece can be flush mounted on the deck as shown in FIG. 8.

In an alternate embodiment of the invention, shown in FIG. 9, the second corner element is not used and the laminate strip 28 extends to the bottom of the edge piece 18.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for forming a countertop comprising:

(a) placing a laminate sheet on the upper surface of a horizontal deck having an elongate exposed vertical edge;

(b) placing a laminate strip on the face side of a vertical edge piece having a length substantially equal to the length of said exposed vertical edge;

(c) cutting a first rectangular notch along the horizontal upper corner of the face side of said edge piece, said notch extending along the entire length of said edge piece;

(d) adhesively joining in said first notch a first rectangularly cross-sectioned elongate corner element having transverse dimensions that are larger than the dimensions of said first notch and a length substantially equal to the length of said edge piece;

(e) forming an arcuate surface on said first corner element that smoothly fairs into said laminate strip after said corner element has been attached to said edge piece;

(f) forming tongue and groove joint elements in the edge of said deck and the back side of said edge piece that interfit so that said edge piece covers the exposed vertical edge of said deck and said arcuate surface smoothly fairs onto said laminate sheet; and (g) adhesively attaching said edge piece to said deck with said tongue and groove elements interfitting, after said corner element has been attached thereto and said arcuate surface has been formed.

2. The method of claim 1 including the additional steps of:

(a) prior to attaching said corner element to said edge piece cutting a second rectangular notch at the lower corner of the face side of said edge piece, said notch extending along the entire length of said edge piece;

(b) adhesively joining in said second notch a second rectangularly cross-sectioned elongate corner piece having transverse dimensions that are larger than the dimensions of said second notch, and a length substantially equal to the length of said edge piece; and (c) forming an arcuate surface on said second corner element that smoothly fairs into said laminate strip.

* * * * *

UNITED STATES PATENT AND TRADEMARK OFFICE

CERTIFICATE OF CORRECTION

PATENT NO. : 5,310,435

DATED : May 10, 1994

INVENTOR(S) : Basil T. Kelley

It is certified that error appears in the above-indentified patent and that said Letters Patent is hereby corrected as shown below:

On the title page, item [57],

Abstract, Line 4 : after the face insert --.--

Column 3, Line 33: after cross insert -- - --

Signed and Sealed this

Fourth Day of October, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,310,435

DATED : May 10, 1994

INVENTOR(S) : Basil T. Kelley

It is certified that error appears in the above-indentified patent and that said Letters Patent is hereby corrected as shown below:

On the title page: Item [75] Inventors:

Delete "Kelly" insert --Kelley --.

Abstract, Line 4, after the face insert --. --.

Column 3, line 33, after cross insert -- - --.

Signed and Sealed this

Tenth Day of January, 1995

*Attest:*

*Attesting Officer*

BRUCE LEHMAN

*Commissioner of Patents and Trademarks*